United States Patent [19]

Biedermann et al.

[11] Patent Number: 4,881,439

[45] Date of Patent: Nov. 21, 1989

[54] CUTTING APPARATUS FOR SHEET MATERIAL

[75] Inventors: Robert E. Biedermann, Brick, N.J.; Albert J. Countryman, New Brighton, Minn.

[73] Assignee: Esselte Pendaflex Corporation, Garden City, N.Y.

[21] Appl. No.: 181,433

[22] Filed: Apr. 14, 1988

[51] Int. Cl.[4] ..... B26D 3/08

[52] U.S. Cl. ..... 83/879; 83/875; 83/564; 83/582; 83/614; 33/32.1; 225/96.5

[58] Field of Search ..... 83/745, 875, 879, 564, 83/614, 881, 886, 582, 824, 698; 33/32.1, 32.2, 32.3, 32.7; 225/96, 96.5, 2

[56] References Cited

U.S. PATENT DOCUMENTS

| | | | |
|---|---|---|---|
| 1,856,128 | 5/1932 | Drake | 33/32.1 |
| 2,184,126 | 12/1939 | Philippe | 33/32.1 |
| 2,435,154 | 1/1948 | Owen | 33/32.1 |
| 2,591,828 | 4/1952 | Judd, Jr. | 33/32.1 |
| 2,705,389 | 4/1955 | Wyman | 33/32.1 |
| 3,126,636 | 3/1964 | Brand | 33/32.1 |
| 3,399,586 | 9/1968 | Insolio et al. | 83/881 |
| 3,626,595 | 12/1971 | Hulen | 33/32.2 |
| 3,889,862 | 6/1975 | Insolio et al. | 83/564 |
| 4,183,274 | 1/1980 | Kingsley | 33/32.1 |
| 4,545,515 | 10/1985 | Kozyrski | 83/614 |

OTHER PUBLICATIONS

C&H, "CHN 210–48 Cardboard, Glass & Plastic Cutter Operating Manual & Parts List", 12 pages.

Fletcher Ad, "The New Generation of Glass, Plastic & Mat Cutting Mach. from Fletcher", (Mar. 84, Decor).

Fletcher Circular 84 Cp 83 (1-page), "Fletcher Quality Close Up".

Fletcher–Terry Catalog No. 80, cover, inside cover, pp. 1, 8, 9.

C&H 8-page brochure (c. 1986), "When You Buy a C&H Mat Cutter You Get a Very Special Edge".

Barton, 1 page circular on Model BCG–48, Cardboard and Glass Cutter.

Logan, 1 page circular on "The Logan Vertical Cardboard, Plastic and Glass Cutter", Model 300.

"The Logan Vertical Cardboard, Plastic and Glass Cutter–Assembly and Operating Instructions" (12 pages).

Fletcher, "Owner's Manual–84XX Series" (Form No. MIB–84 12/83) (14 pages).

*Primary Examiner*—Douglas D. Watts
*Assistant Examiner*—Scott A. Smith
*Attorney, Agent, or Firm*—Darby & Darby

[57] ABSTRACT

Cutter apparatus is provided for sheet material, such as glass, plastic (e.g., plexiglass) or matte boards, particularly designed for use in picture framing, although also usable wherever such sheets need simple and reliable cutting apparatus. The cutter has means for holding a sheet of material in a position to be cut, a guide, and a cutter assembly or slide movable along said guide. The cutter assembly includes a movable cutter carrier resiliently urged toward said material. The cutter carrier holds two separate cutting elements, either one of which can be presented to the sheet material by pivoting the carrier. A lever moves the cutter carrier away from said material. A latch is provided for retaining the lever in a position with said cutter carrier retracted from said material, the latch being normally inoperative. Movement of the slide to the end of a cutting stroke places the latch in an operative condition to hold the lever, and thereby keeps the cutter carrier away from the sheet material to permit freely moving it and the cutter. The lever is coupled to the carrier by a linkage which both limits the movement of the carrier toward the sheet material, and by over-center action may lock the cutter element in fixed relation to the material.

14 Claims, 5 Drawing Sheets

CUTTING APPARATUS FOR SHEET MATERIAL

The present invention concerns cutting apparatus for sheet material, such as glass, plastic or cardboard (e.g., matboard or fiberboard).

Cutting apparatus for such sheet material conventionally includes a normally horizontal rest for the sheet material, a guide extending at right angles to the rest, and a cutter head assembly movable along the guide and adapted to hold a blade or cutter for engagement with the sheet material.

The present invention provides an apparatus of that general type which makes use easier and more rapid. In particular, it permits cutting or scoring sheet material by a single stroke, provides a simple and convenient mechanism for adapting the apparatus for cutting various types of sheet material, and for placing special cutters (such as for glass or plastic or cardboard) into operative position. For this purpose, a special blade holder is provided, which is made pivotable to switch from a cardboard cutter to a glass or plastic sheet cutter. Replaceable and interchangeable cuttercarrying cartridges permit operating on glass or plastic.

In addition, the present apparatus provides a ready means for adjusting the pressure of the cutter element against the sheet material being cut, and permits selection between applying a uniform resilient force to the cutting element or else locking the cutting element rigidly into position.

A particularly convenient arrangement is provided for retracting the blade holder from its cutting position to a retracted position, to permit ready insertion and removal of the sheet material being processed.

In the present invention, a stable track or guide rail is provided for a movable head assembly holding the cutter blade holder. The head assembly is provided with a slide block having a slot with v-shaped ends cooperating with a v-bar guide rail. A handle-activated spring tension mechanism is provided for holding glass, plexiglass or matboards of differing thicknesses firmly in position during cutting. A simple adjustment is provided to assure exact right angle corners when cutting.

The cutter head provides an adjustable spring tension for increasing or decreasing the scoring severity when cutting glass or plexiglass. The blade holder is provided with means for readily retracting it to a neutral position, for upstroke movement. The blade holder holds two cutting tools at all times, namely, a cardboard blade and a glass or plexiglass cutter, as desired. The cutter scores sheet material, and particularly glass and plastic sheets, on the downstroke for more ready and uniform scoring.

The cutter is readily convertible from a spring-loaded downstroke (as for a first cut on thick cardboard material) to being locked rigidly in place, as for a second downcut or for thin board cutting. The apparatus has the ability to quickly change from a glass or plexiglass scoring cutter to cardboard cutting. At the bottom of a stroke, means are provided for readily retracting the blade holder to a neutral position, not only to permit sheet material to be inserted for cutting or to be removed, but also for ease of movement of the head assembly to the top of the sheet material being cut, preliminary to the next down stroke. A glass cutter is automatically guided over the top edge of the glass sheet to avoid chipping at the edge which might harmfully affect the ability to break the glass cleanly.

Further advantages and objects of the present invention will be more readily apparent from the following description of a preferred embodiment, taken in conjunction with the appended drawings, in which.

Figure 1:
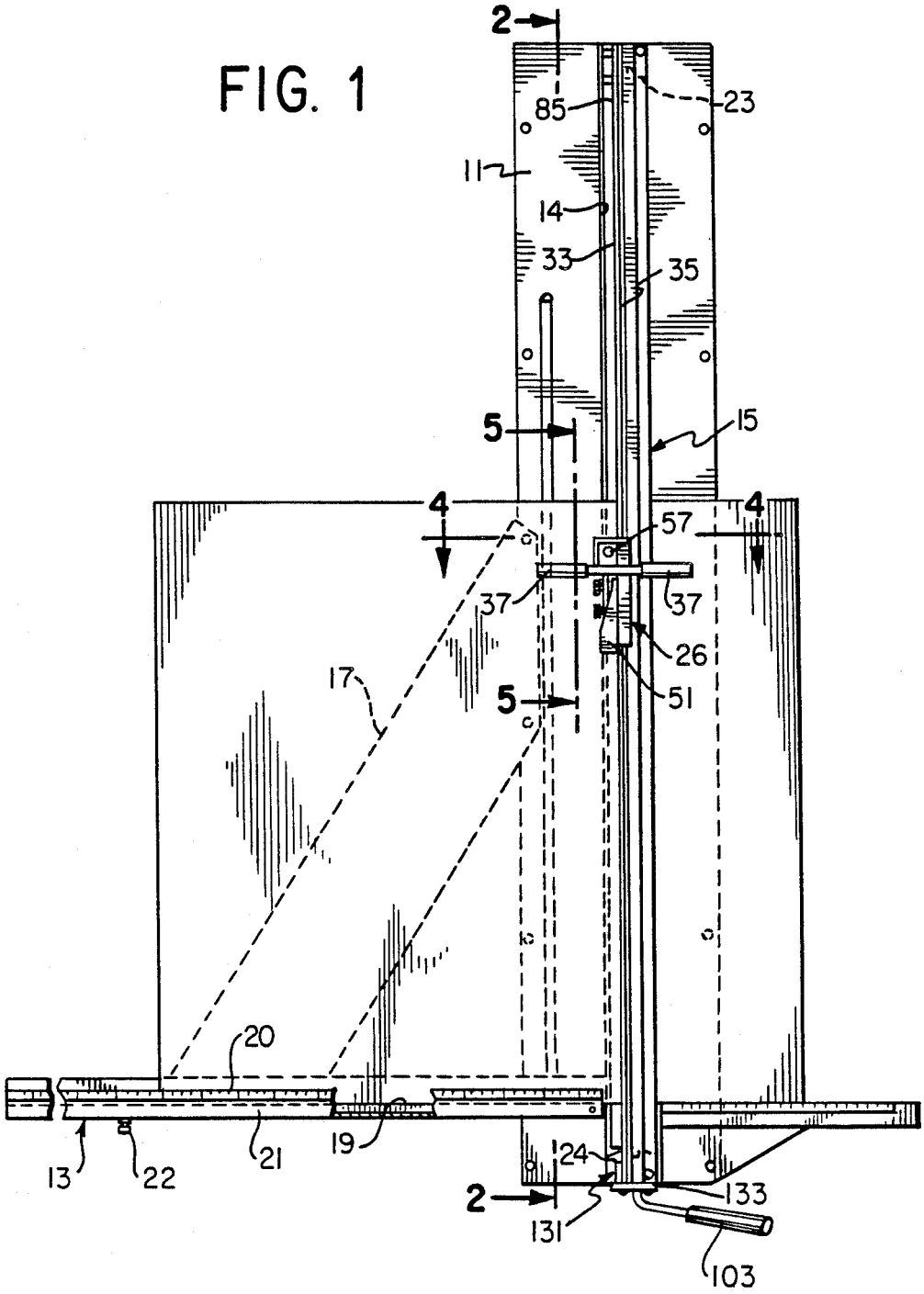
FIG. 1 is a front elevation view of the cutter of the present invention when mounted vertically.
Figure 2:
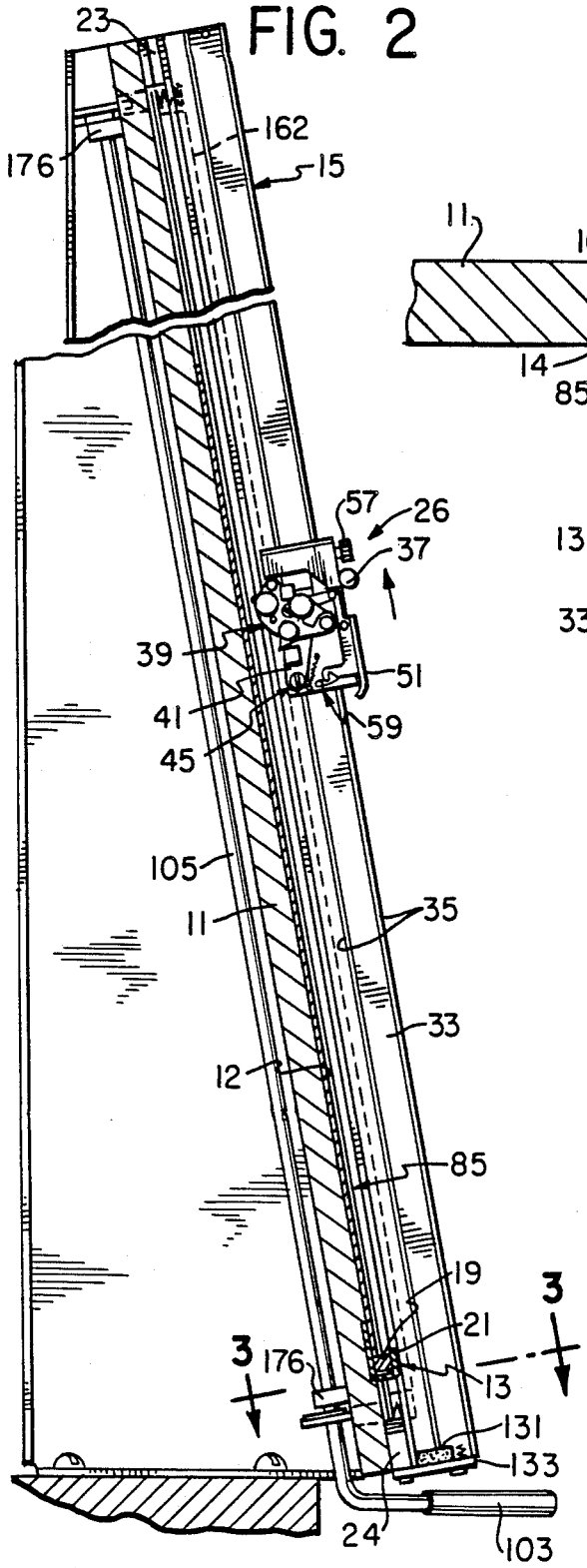
FIG. 2 is a side elevation sectional view of the cutter of FIG. 1, viewed along line 2—2 of FIG. 1.

FIGS. 1 and 2 show the general nature of the cutting apparatus of the present invention. The cutter apparatus may be placed in a substantially vertical or a horizontal position, but for simplicity will be described as though in a vertical position. It comprises a flat, relatively long (e.g. 65 inches), and narrow (e.g. 8 inches) base board 11 in a nearly vertical plane which may be slanted slightly backward as seen in FIG. 2, better to support a sheet 12 of glass, plastic or cardboard to be cut. The board 11 may be made of wood (e.g. particle board), metal or other material. Mounted at right angles to base board 11 is a horizontally extending material rest 13, which may be provided with a conventional slight adjustment to assure positioning it substantially exactly perpendicular to the vertical axis of the base board 11. As shown, material rest 13 may extend on both sides of base board 11. A support or brace 17 may join base board 11 and material rest 13 to hold them rigidly relative to one another.

Mounted on base board 11 and parallel to its axis is a guide rail 15 spaced slightly from base board 11 by top and bottom riser blocks 23, 24 to permit placement of the sheet material 12 therebetween. Rest 13 is provided with a leveler rail 19, pivotally joined at one end to the main body 21 of rest 13 and adjustably movable at the other end with respect to rest 13 by a leveler screw 22, to permit exact angular positioning of leveler rail 19 to a position at right angles to guide rail 15. The sheet material 12 to be cut is supported by leveler rail 19. A rule 20 may be secured to rest 13 to indicate horizontal distance from the cutter edge of the cutter assembly, to aid in cutting material to desired size. A rule may also be placed on baseboard 11, at a suitable position.

Figure 4:
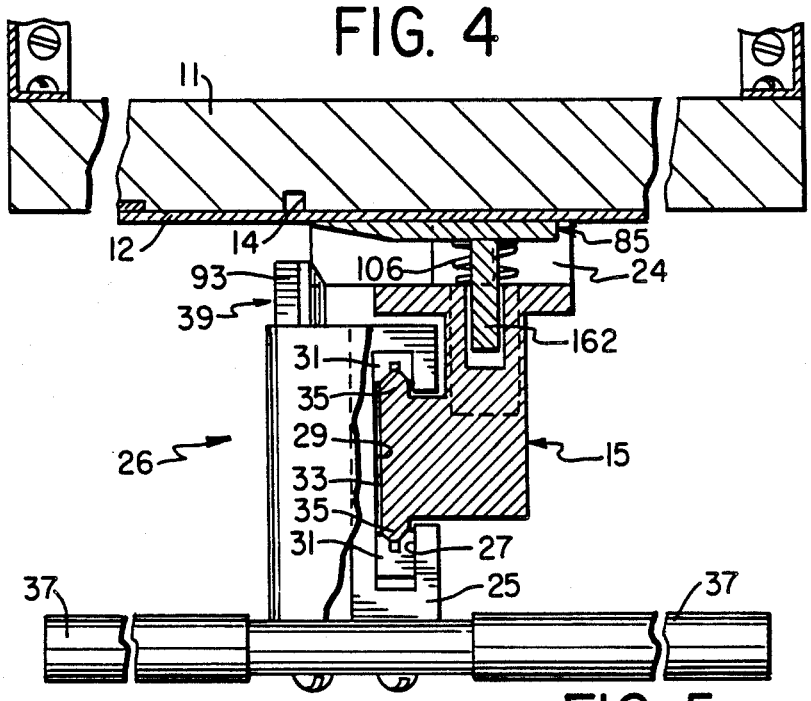
FIG. 4 is a horizontal sectional view along line 4—4 of FIG. 1.

Referring to FIG. 4, the cutter head assembly 26 is mounted on a slide block 25 having a channel 27 with a flat surface 29 and v-shaped grooves 31 at the ends of the channel. Guide rail 15 has a complementary flat surface 33 and v-shaped edges 35 which fit into grooves 31, which may be provided with an anti-friction coating such as teflon. Thus, the block 25 is readily slidable up and down the guide rail 15. A pair of horizontally extending handles 37 secured to slide block 25 permit manipulation of the head assembly 26 up and down the guide rail 15.

The head assembly 26 is shown in FIGS. 5 to 8, in differing configurations and positions. It includes a cutting tool holder assembly 39 which is pivotally mounted on an actuator arm 41 by a pivot pin 43. Arm 41 is pivotally connected to slide block 25 by a pivot pin 45. A link 49 is pivotally connected to actuator arm 41 at one end and pivotally joined to operating lever 51 at the other end 50. Lever 51 is pivotally connected to slide block 25 at pivot pin 53.

Figure 8:
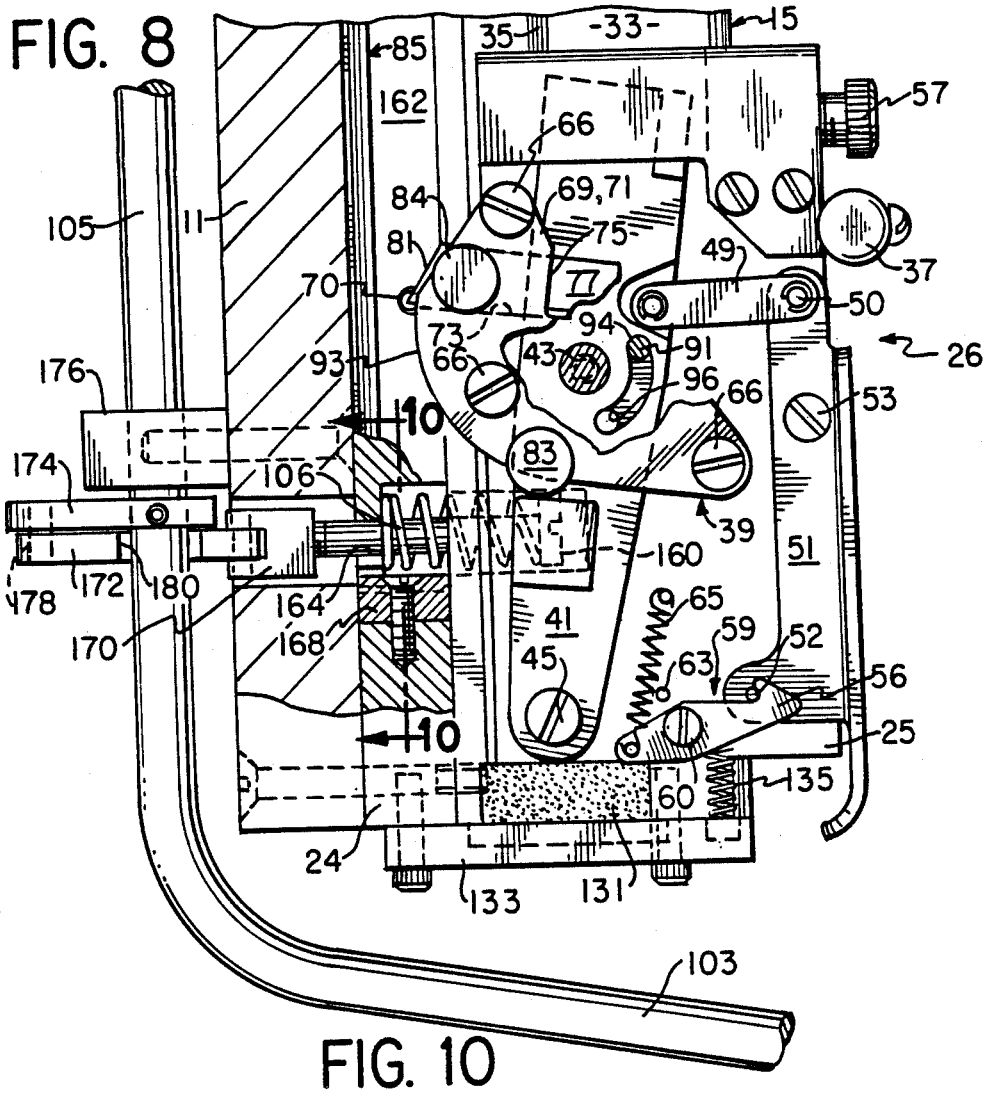
FIG. 8 is a view similar to FIG. 5, at the end of the downstroke.

Actuator arm 41 is resiliently urged toward the base board 11 by a main compression spring 55 bearing on a recess 56 in one end of arm 41, and whose resilient force is adjustable by adjustment screw 57. A hook latch 59 is pivotally connected to slide block 25 at 60, and is resiliently urged toward engagement with a stop pin 63 fixed to slide block 25, by a tension spring 65 as seen in FIG. 8. Latch 59 engages pin 52 on lever 51 to hold lever arm 51 in a position at which link 49 holds actuator arm 41 (against the force of spring 55) in a position which retracts tool holder 39 away from base board 11 and any sheet material 12 resting thereon as shown in FIG. 8.

Figure 6:
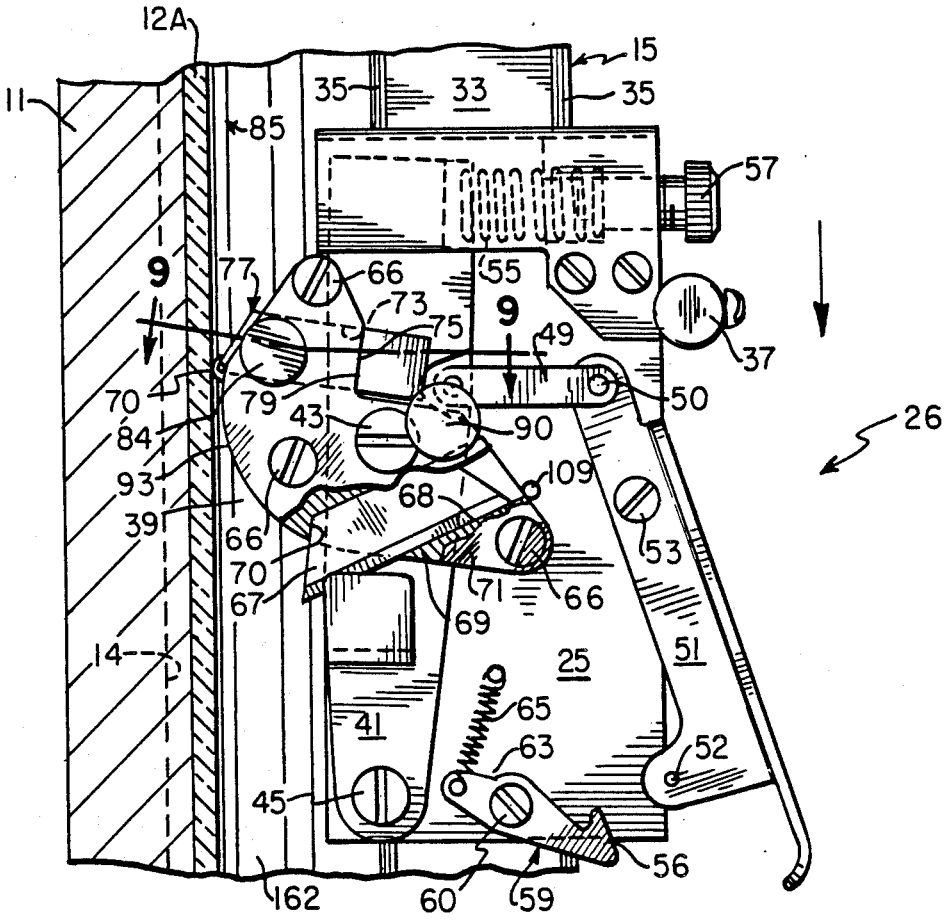
FIG. 6 is a similar view in a configuration for a downward stroke for scoring glass.
Figure 9:
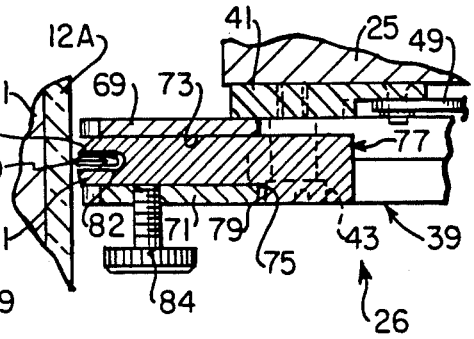
FIG. 9 is a fragmentary sectional view of the glass cutting element and its holder, viewed along line 9—9 of FIG. 6.

Tool holder assembly 39 is formed of two flat pieces 69, 71 (see FIG. 9) joined by screws 66 or the like. Pieces 69, 71 are adapted to hold a cutting blade 67 removably between them. One piece 70 has a grooved clearance channel or slot 68 (FIG. 6) adopted to receive blade 67, which protrudes from tool holder 39 by an appropriate distance. Channel 68 has a shoulder 70 as shown in FIG. 6, which serves as a stop to locate blade 67 fixedly as to tool holder 39. Blade 67 is clamped to holder 39 by a thumb screw 83. Tool holder 39 also has a channel 73 formed by pieces 69, 71. An edge 75 on piece 71 serves as a stop for a cartridge 77 adapted to be inserted in channel 73. One form of cartridge 77 shown FIG. 9 holds a rotatable circular glass-cutter wheel 70 between arms 81. Wheel 70 may be rotatably mounted in a resilient clip 82 which removably retains wheel 70 between arms 81. Cartridge 77 may be inserted in channel 73 and its shoulder 79 cooperates with edge 75 to fix the position of cutter wheel 79 in tool holder 39. A clamping screw 84 similar to screw 83, serves to hold cartridge 77 in place. A second form of cartridge 77A of generally the same shape holds a removable plastics-cutting blade 86 at its end opposite its shoulder 79A (see FIG. 7). Cartridges 77 or 77A may be interchangeably mounted on tool holder 39 and clamped in position by screw 84. In the cutting position, the cutter wheel 79 or the plastics cutting blade 86 is in proper position relative to whichever sheet materials 12 are being cut.

Figure 5:
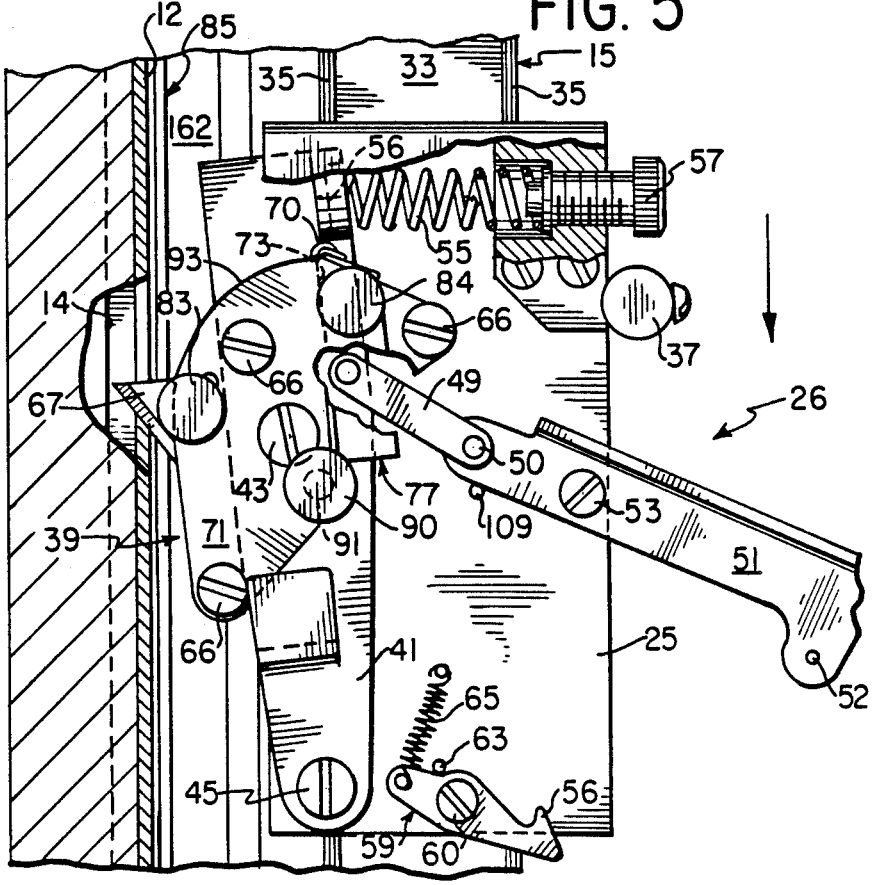
FIG. 5 is a fragmentary sectional view of the head assembly taken on line 5—5 of FIG. 1, in a configuration for a downward stroke for cutting matboard.

As pointed out above, the present cutter is adapted for cutting sheets of glass or plastic or cardboard (such as matboard for picture framing or backing). These various materials require different cutter elements. For cardboard (or matboard or fiberboard) a knife blade 67 is used, as shown in FIG. 5, for cutting or scoring the sheet material. For glass, a cutter wheel 70 (seen in FIG. 6 or 9) is used for scoring the glass to permit breaking it on the score line. For plastic materials, a cutter blade 86 (seen in FIG. 7) is used, which carves a thin kerf in the material by removing a narrow strip, in one or several strokes, before breaking the material on the cutting line.

An important feature of the present invention is the special mounting for the tool holder 39, which permits either the cardboard cutting blade 67 or the glass cutting wheel 70 to be presented to the sheet material 12 to be cut. Thus, the tool holder 39 is pivoted on the actuator arm 41 by pivot pin 43. In FIG. 5 the tool holder 39 is shown in position for cutting cardboard, with blade 67 in operative position. In a second position, for cutting glass, shown in FIG. 6, the tool holder 39 is rotated to a position where the glass-cutter wheel 70 engages the sheet of glass 12A which is to be cut. The blade holder 67 is appropriately shaped so that when in the position of FIG. 6, the rotary glass cutter wheel extends from the tool holder 39 toward the baseboard 11 by a smaller distance than does the cardboard cutting blade 67, which is now rotated away from a position of engagement with the sheet material 12 being cut.

The tool head assembly 39 may be held in either of these two positions of FIGS. 5 or 6 by means of a locating pin 91 having a knob 90 and which engages either of two appropriately positioned holes 96, 94 (FIG. 8) in the actuator arm 41 beneath the tool holder 39. The pin 91 may be spring-biased toward the actuator arm 41 so that when the tool holder 39 is in the proper position, the pin 91 will fall into the appropriate hole 94 or 96 of the actuator arm 41.

Figure 7:
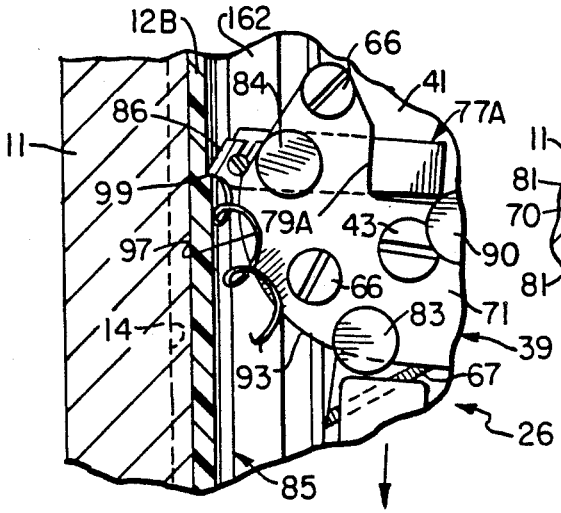
FIG. 7 is a similar view in a configuration for a downward stroke for scoring plastic.

In place of the glass cutter wheel 72 in cartridge 77, cartridge 77A may be inserted as seen in FIG. 7, carrying a plastic cutting blade 86. In FIG. 7, blade 86 is shown in engagement with a plastic sheet material 12B in which it is cutting a shallow groove by removing a slight amount of material seen at 97. For this purpose, blade 86 is provided with a hook cutting point 99 as seen in FIG. 7, which gouges out material from sheet 12B, in a fashion similar to a lathe tool.

Figure 3:
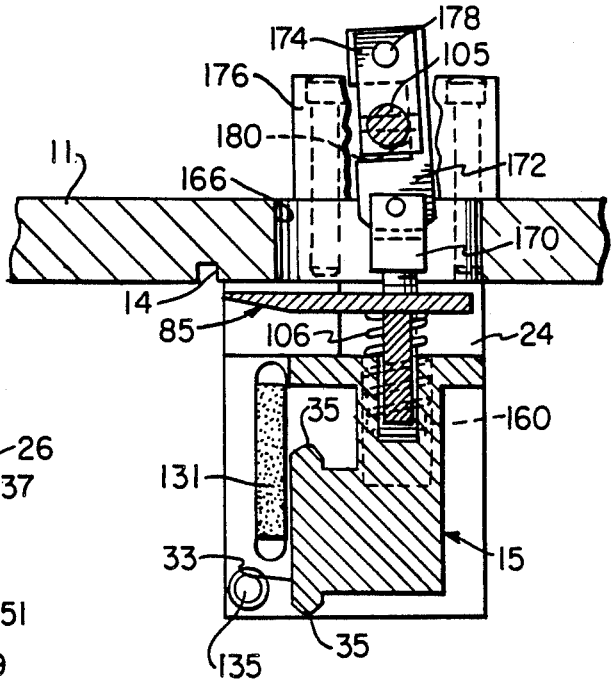
FIG. 3 is a horizontal sectional view of the cutter of the invention viewed along line 3—3 of FIG. 2.
Figure 10:
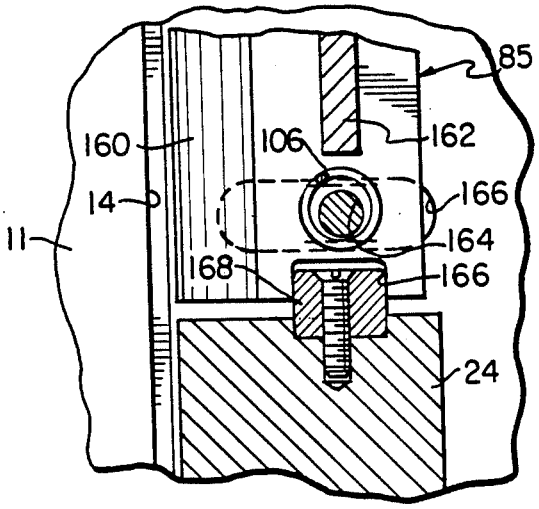
FIG. 10 is a sectional view taken along the line 10—10 of FIG. 8.

The tool holder 39 is initially held in a retracted position spaced from the baseboard 11 as seen in FIG. 8. This is done by urging operating lever 51 clockwise until pin 52 carried by lever 51 engages hook 56 on latch 59, which is pivotally mounted by pivot screw 60 on slide block 25. Latch 59 is usually held in disengaged position by spring 65, but when displaced counterclockwise will engage and retain pin 52 of lever 51 in the hook 56. When lever 51 is thus moved to be latched, actuating arm 41 is moved clockwise by link 49 against the force of main spring 55, to move tool holder 39 away from baseboard 11, to permit mounting of a sheet (e.g. matboard 12 of FIG. 5 or glass sheet 12A of FIG. 6 or plastic sheet 12B of FIG. 7) on rest 13, between baseboard 11 and clampinq shoe 85 (see FIG. 3, 4 or 5). As seen in FIGS. 3, 8 and 10, the various materials to be cut/scored etc. are clamped against board 11 by clamp shoe 85. The clamp shoe 85 is guided and actuated at it top and bottom by identical mechanisms. Only the lower mechanism will be described in detail. Operation of handle 103 to a relaxed position actuates rod 105 to relax spring 106 and release sheet 12. Operation of handle 103 in the opposite direction pulls on rod 105 to compress spring 106 against shoe 85 which exerts clamping force on sheet 12 which is maintained by the overcenter linkage between rod 105 and handle 103.

When the tool holder 39 is in the retracted position, the cutter head assembly 26 may be moved freely across and above the sheet 12, in preparation for the cutting stroke. Preliminarily the operating lever is moved toward baseboard 11. This disengages pin 52 from hook 56 of latch 59, permitting latch 59 to be rotated by spring 65, and releasing lever 51, as shown in FIG. 5. This allows main spring 55 to move arm 41 and tool holder 39 toward baseboard 11, while lever 51 moves counterclockwise. The most that arm 41 can move is into a position where link 49 is aligned with lever 51. In that position blade 67 enters a groove 14 extending along the baseboard 11, but tool holder 39 remains slightly spaced from material 12, generally as shown in FIG. 5.

The entire head assembly 26 may now be moved downward by pulling down on handles 37. Blade 67 will now ride down in groove 14 to sever the cardboard material 12, as shown in FIG. 5. By pulling the head assembly 26 all the way down, the material is completely severed, as desired. It will be understood that the main spring 55 is adjusted so as to keep the blade 67 engaged with material 12.

In the case of a very thick board, the force of spring 55 may not be sufficient to cause the blade 67 to penetrate into the board 12 all the way. The blade 67 may ride partially up on material 12 against the spring force on arm 41, and will then make only a partial cut into the material during the downward stroke. The depth of the cut is determined by spring adjusting screw 57.

The downward strike continues until at the bottom slide block 25 hits a soft rubber bumper 131 held by an end piece 133, shown in FIG. 8. End piece 133 also holds a compression spring 135 which then is impacted by latch 59 and moves latch 59 upward against the force of latch tension spring 61. In this position, operating lever may again be moved toward baseboard 11, to engage add be retained by latch 59. This movement retracts arm 41, tool holder 39 and blade 67, permitting the entire cutter head assembly 26 to be again lifted above the top edge of the sheet 12. Then lever 51 is again released, allowing tool holder 39 and blade 67 to be positioned in the operative position, and a second stroke may be performed as before. This operation may be repeated until the sheet 12 is completely severed.

In some situations, it may not be desired to rely on the resilient force from the main spring 55 to keep blade 67 in position. The present invention provides an additional feature useful under these circumstances. The lever 51 (which is pivoted on the slide block 25 at 53) and the link 49 (which is pivotally connected to lever 51 at 50) are so arranged that the lever 51 may move beyond a position of direct alignment with link 49 to a "over-center" position, as shown in FIG. 5, until limited by stop pin 109. In this position, the actuator arm 41 and the tool assembly 39 carried by it are held essentially rigidly locked in relation to the baseboard 11 by spring 55 so as to permit a strong cut. This is particularly useful with thinner sheet material.

FIG. 6 shows the tool holder 39 with glass cutter wheel 72 in operative position to cut a glass sheet 12A. Before attaining this position, it will be understood that the head assembly 26 (with tool holder 39 and arm 41 retracted) was moved above the top edge of the sheet 12A. Then lever 51 was released, moving the tool holder 39 toward baseboard 11. Again the tool holder 39 would move until link 41 and lever 51 were aligned, or until the rounded periphery 93 of tool holder 39 touched the baseboard 11, with cutter wheel 70 entering groove 14. In either case, periphery 93 is arranged to be closer to baseboard 11 than the customary thickness of glass sheet 12A. This provides another feature and advantage of the present invention.

Thus, on moving the head assembly 26 downward, the top edge of the glass sheet 12A impinges first on the curved periphery 93, which causes the tool holder 39 to be moved (against spring 55) so as to lift the cutting wheel 70 and prevent it from chipping the top of the edge of the glass sheet, which otherwise frequently impairs the ability to attain a clean break of the glass.

Then moving the head assembly 26 downward causes the wheel 70 to score the glass sheet 12A as desired. Appropriate pressure is provided by adjustment of knob 57 A single stroke downward is sufficient to provide the necessary scoring for the desired clean break, which is obtained by moving the sheet 12A until the score line is just over the right edge of baseboard 11. When clamped there by the clamping arrangement just described, the glass may be readily broken exactly on the score line.

FIG. 7 shows the present invention applied to cutting a plastic sheet 12B. Here cartridge 77A carries plastic cutter element 86, and replaces cartridge 77 of FIG. 5. Otherwise the structure is in the same configuration as in FIG. 6. In use, the head assembly 26 is moved freely to a position where the cutter element 86 is substantially aligned with the top edge of sheet 12B. Then lever 51 is released from latch 59 (by disengaging pin 52 from hook 56 and allowing spring 61 to retract latch 59). Lever 51 may then be manipulated to lower cutter element 86 gently on to the front surface of sheet 12B at its top edge. The cutter element 86 here cuts a narrow kerf in sheet 12B by removing a narrow strip 99 from sheet 12A. The main spring 55 is adjusted to provide proper force for the desired depth of cut. The cut may be increased by successive strokes as described above.

The present invention has therefore provided an efficient, convenient and simply usable apparatus for cutting various sheet materials, with cutting elements for the most common materials (cardboard and glass) being available at all times on the apparatus, selectable by a simple adjustment of the blade holder. The apparatus automatically accommodates sheet materials of any thickness up to the maximum capacity determined by the range of movement of the clamping shoe. As a safety feature, such adjustment is made possible only with the blade holder in the retracted position, since otherwise the adjustment is opposed by spring 55.

It will be understood that modifications and variations in the structure here described may readily be made by ordinarily skilled persons, in that the invention is to be deemed to be defined by the following claims.

What is claimed is:

1. Apparatus for cutting sheet material or the like, comprising:

a. a holder for said sheet material;
b. a slide movable along said material;
c. a carrier for a cutter element;
d. a first member on which said carrier is pivotally mounted, said first member being pivotally connected to said slide;
e. resilient means urging said first member and carrier toward said material;
f. a linkage including a lever for moving said first member away from said material;
g. a latch for retaining said lever in a position in which said carrier is spaced from said material; said latch having a normal position disengaged from said lever and having an operative position in which it is adapted to engage said lever; and
h. means responsive to movement of said slide to one end of the range of its movement for placing said latch in its operative position.

2. Apparatus as in claim 1 further including a second cutter element carried by said carrier, said carrier being arranged to have two positions in relation to said first member, in each of which positions a respective cutter element is presented in operative cutting relation to said material.

3. Apparatus for cutting sheet material or the like, comprising:

a. a holder for said sheet material;
b. a slide movable along said material;
c. a carrier for a cutter element;
d. a first member on which said carrier is pivotally mounted, said first member being pivotally connected to said slide;
e. resilient means urging said first member and carrier toward said material;
f. a second cutter element carried by said carrier, said carrier being arranged to have two positions in relation to said first member, in each of which positions a respective cutter element is presented in operative cutting relation to said material;
g. a linkage including a lever for moving said first member away from said material, said linkage having an over-center position cooperating with said resilient means to retain said carrier substantially rigidly in relation to said slide block; and
h. a latch for retaining said lever in a position in which said carrier is spaced from said material.

4. Apparatus for cutting sheet material or the like, comprising:

(a) a holder for said sheet material;
(b) a slide movable along said material;
(c) a first member pivotally connected to said slide;
(d) a cutter element;
(e) a carrier for said cutter element pivotally connected to said first member;
(f) resilient means urging said first member toward said material to present said cutter element to said material, whereby said cutter element is urged by said resilient means into contact with said material;
(g) a lever pivotally connected to said slide, and
(h) a link pivotally connected at one end to said lever and at the other end to said first member;
(i) said lever and link having an over-center relationship in a predetermined position of said lever to lock said cutter element in a fixed position relative to said material.

5. Apparatus as in claim 4 further including a latch mounted on said slide for retaining said lever in a position retracting said cutter element from said material.

6. Apparatus for cutting sheet material comprising:

(a) a holder for said sheet material;
(b) a slide movable along said material;
(c) a cutter element on said slide;
(d) means resiliently urging said cutter element toward said material;
(e) means including a movable latch for retaining said cutter element in a retracted position, and
(f) means responsive to movement of said slide to a predetermined position for setting said latch in a position to retain said cutter element.

7. Apparatus for scoring a glass sheet material or the like comprising:

a. a holder for said sheet material;
b. a slide movable along said material;
c. a glass scoring element;
d. a carrier fixedly holding said element;
e. a first member on which said carrier is pivotally mounted, said first member being freely pivotally connected to said slide;
f. resilient means urging said first member and carrier toward said material;
g. means responsive to movement of said slide and including a curved periphery on said carrier facing said material, with one portion of said periphery spaced from the edge of said scoring element by a distance less than the thickness of said material to cause said carrier to pivot relative to said first member to cause said carrier to lift said scoring element over the edge of said material upon movement of said slide from a position above the upper edge of said material to a position opposite said material.

8. In a cutter for sheet material having means for holding a sheet of material in a position to be cut, a guide rail and a cutter assembly movable along said guide rail, the improvement comprising a cutter carrier forming part of said assembly,
said cutter carrier holding two cutting elements at different locations,
said cutter carrier being pivotally mounted to present either one of said cutter elements to an operative position with respect to the sheet material be cut,
means resiliently urging said cutter carrier toward said material,
a lever for moving said cutter carrier away from said material,
a movable latch for retaining said lever in a position in which said cutter carrier is retracted away from said material, said latch being normally inoperative to retain said lever, and
means responsive to positioning said cutter assembly at one end of its range of movement along said guide rail for placing said latch in a position operative to retain said lever.

9. An apparatus as in claim 8 including means for locking said lever in a fixed position to hold said cutter carrier in a fixed position in said assembly regardless of said resilient urging.

10. Apparatus for cutting sheet material or the like, comprising:

a. a holder for said sheet material;
b. a slide movable along said material;
c. a first member pivotally connected to said slide;
d. a cutter element;
e. a carrier for said cutter element pivotally connected to said first member;
f. resilient means urging said first member toward said material to present said cutter element to said material, whereby said cutter element is urged by said resilient means into contact with said material;
g. a lever pivotally coupled to said first member, and
h. means responsive to movement to said slide for locking said lever in a fixed position to hold said carrier in a fixed position regardless of said resilient means.

11. Apparatus as in claim 10 wherein said locking means comprises a latch movably mounted on said slide for retaining said lever in a position retracting said cutter element from said material.

12. Apparatus for cutting sheet material or the like, comprising:

a. a holder for said sheet material;
b. a slide movable along said material;
c. a first member pivotally connected to said slide;
d. a cutter element;
e. a carrier for said cutter element pivotally connected to said first member;
f. resilient means urging said first member toward said material to present said cutter element to said material, whereby said cutter element is urged by said resilient means into contact with said material;

g. a lever pivotally connected to said slide;

h. means for locking said lever in a fixed position to hold said carrier in a fixed position regardless of said resilient means;

i. said apparatus further comprising an overcenter linkage arrangement between said lever and said first member responsive to a predetermined position of said lever to lock said cutter element in a fixed position relative to said material.

13. Apparatus for cutting sheet material or the like, comprising:

a. a holder for said sheet material;

b. a slide movable along said material;

c. a carrier for a cutter element;

d. a first member on which said carrier is pivotally mounted, said first member being pivotally connected to said slide;

e. resilient means urging said first member and carrier toward said material;

f. a linkage including a lever for moving said first member away from said material; and g. said linkage also including a link pivotally coupled to said lever at one end and to said first member at the other end, and said lever being pivotally mounted on said slide whereby the movement of said first member is limited when said link and lever are aligned, to limit the approach of said cutter element to said sheet material.

14. Apparatus as in claim 13, said link and lever forming an over-center arrangement for fixing said first member and carrier in relation to said slide.

* * * * *